United States Patent [19]

Ilitzky

[11] 4,355,473

[45] Oct. 26, 1982

[54] MOLDED SHOE

[76] Inventor: Zelik M. Ilitzky, Enrique Rodo 2986, Providencia, Guadalajara, Mexico

[21] Appl. No.: 191,674

[22] Filed: Sep. 29, 1980

[51] Int. Cl.[3] ..... A43B 3/12; A43B 23/00

[52] U.S. Cl. ..... 36/11.5; 36/48

[58] Field of Search ..... 36/11.5, 12, 47, 48, 36/49

[56] References Cited

U.S. PATENT DOCUMENTS

| | | | |
|---|---|---|---|
| 2,252,216 | 8/1941 | Sterzik . | |
| 2,283,273 | 5/1942 | Marcy . | |
| 2,368,314 | 1/1945 | Marx . | |
| 2,434,024 | 1/1948 | Vlasak | 36/11.5 |
| 2,538,170 | 1/1951 | Stritter | 36/11.5 |
| 2,588,061 | 4/1952 | Vesely | 36/11.5 |
| 2,760,279 | 8/1956 | Jones et al. . | |
| 2,761,224 | 9/1956 | Gardiner | 36/11.5 |
| 3,000,116 | 9/1961 | Ally . | |
| 3,063,167 | 11/1962 | Scholl | 36/11.5 |
| 3,204,346 | 8/1965 | Lockard et al. . | |
| 3,991,491 | 11/1976 | Huang . | |
| 4,172,330 | 10/1979 | Kao . | |

FOREIGN PATENT DOCUMENTS

| | | | |
|---|---|---|---|
| 87511 | 3/1956 | Norway | 36/11.5 |

*Primary Examiner*—Patrick D. Lawson

*Attorney, Agent, or Firm*—Jacobs & Jacobs

[57] ABSTRACT

A shoe has a preformed lower portion which is molded preferably from plastic material, and which has on its top surface, around the upper peripheral edge and slightly inward thereof, a plurality of downwardly directed slots for receiving a selected upper of the shoe. The selected type of upper is suitably sized in advance and has at the edge of the depending sides thereof a plurality of substantially V-shaped extended sections providing a serrated edge for insertion into the slots in the top surface of the lower portion of the shoe. The upper is retained in the lower portion of the shoe by staples or nails inserted into the lateral edge thereof through the extended sections. The slots are preferably V-shaped and the lateral edge preferably extends above the top surface so as to cover the top of the sections of the upper.

6 Claims, 7 Drawing Figures

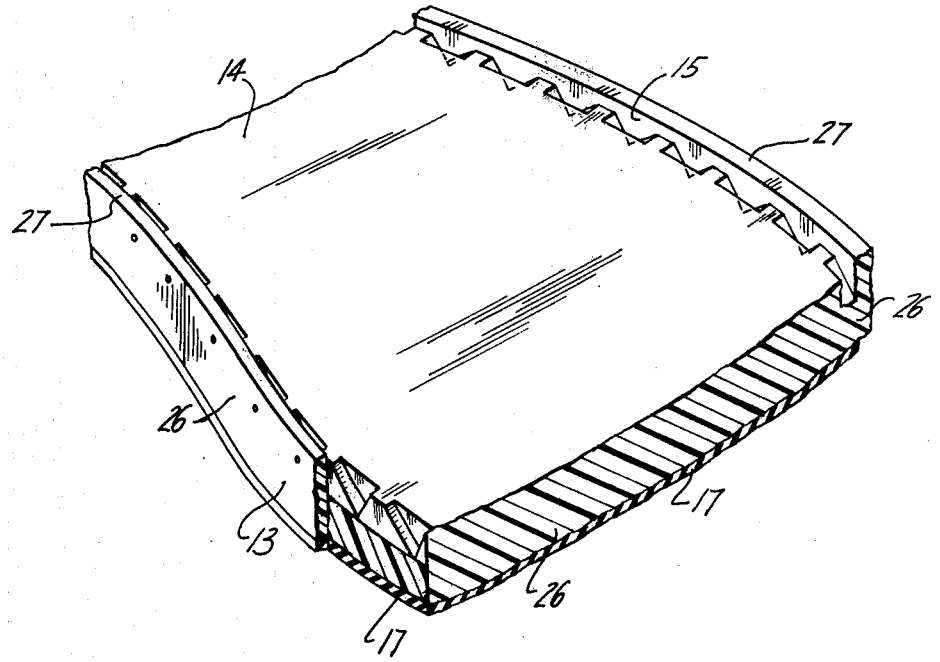
FIG. 1A
FIG. 2A
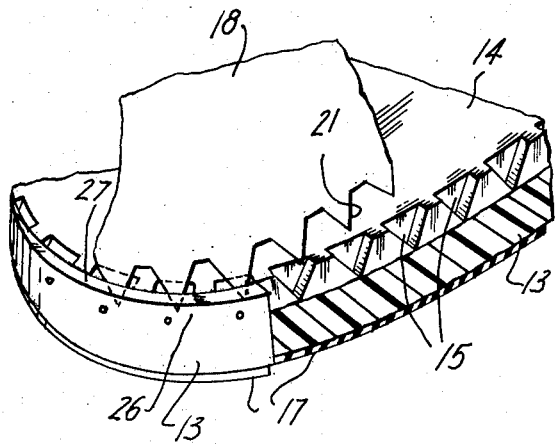

MOLDED SHOE

The present invention relates to a shoe and more particularly to a shoe wherein the lower portion of the shoe comprising the platform, shank and heel is molded in one piece and the upper of the shoe, comprising at least a vamp, and optionally a tip or quarter and ankle strip, if any, may be selectively affixed to said molded lower portion, or an upper comprising all said parts may be affixed in one piece.

It is well known to provide a basic shoe construction of molded plastic to form the platform, shank and heel of the shoe. It is also well known to provide such molded lower portion of the shoe with various types of uppers such as a vamp, a tip and/or vamp and quarter, and straps to hold the preformed molded lower portion of the user's foot.

Heretofore, the construction of shoes in the aforementioned manner presented several problems in manufacture and appearance. The uppers were attached by nailing or stapling along the edge of the depending sides of the upper to the lateral edge of the lower portion of the shoe, creating an unsightly appearance. The variations in placement of the upper created sizing discrepancies. Furthermore, the proper placement of the upper required at least a modicum of skill in the operator.

The present invention has solved these problems by providing a preformed lower portion of a shoe, which is molded preferably from plastic material, and which has on its top surface around the upper peripheral edge and slightly inward thereof, a plurality of downwardly directed slots. The selected type of upper is suitably sized in advance and has at the edge of the depending sides thereof a plurality of substantially V-shaped extended sections providing a serrated edge for insertion into the slots in the top surface of the lower portion of the shoe. The upper is retained in the lower portion of the shoe by staples or nails inserted into the lateral edge of said lower portion through said extended sections.

In the following description and in the claims, parts will be identified by specific names for convenience, but such names are intended to be as generic in their application to similar parts as the art will permit. Like reference characters denote like parts in the several figures of the drawing, in which:

FIG. 1A is an enlarged transverse section taken along the lines A—A of FIG. 2 with a portion of the wall of the shoe broken away to show the interior of the slots.

FIG. 2A is an enlarged sectional view of a portion of a shoe detailing the attachment of the upper to the lower portion of the shoe.

Figure 1:
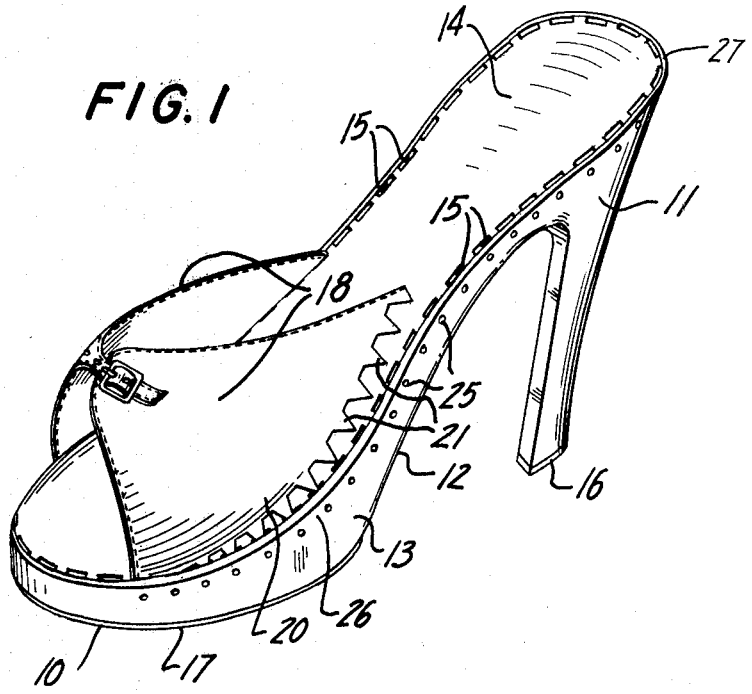
FIG. 1 is a perspective view of a shoe constructed according to the present invention with a portion of the upper not completely seated and secured in the slots of the lower portion of the shoe.

Referring to the drawings, FIG. 1 shows a basic structure for the lower portion of a shoe 10 having a heel 11, a shank 12, and a platform 13, which is preferably formed of molded plastic such as polyvinyl chloride (PVC) or any other suitable moldable plastic and sized in conformance with standard shoe sizes and dimensions. While the lower portion of the shoe shown in FIG. 1 includes a high heel 11, it will be understood that the lower portion may be formed as a high heeled shoe, a wedge shoe, a low heeled shoe, or any other desired type to which the present invention may be adapted. The top surface 14 of the lower portion of shoe 10, inward of the periphery, is provided with a plurality of preferably V-shaped slots 15 having elongated openings which project downwardly but do not extend through the lower portion and which are disposed slightly inwardly of the side edges and around the periphery of surface 14. The preformed upper 18, here shown as a vamp, is sized in conformity with standardized shoe sizes and dimensions and is provided with a plurality of preferably substantially V-shaped extended sections 21 at the edges of the depending sides 20 of upper 18. Sections 21 are adapted to be inserted in the corresponding slots 15 in surface 14 and and secured by nails 25 of staples (not shown) inserted into the lateral edge 27 of the lower portion. Lateral edge 26 preferably extends above surface 14 at 27 so as to cover the top of sections 21 of upper 18.

Figure 2:
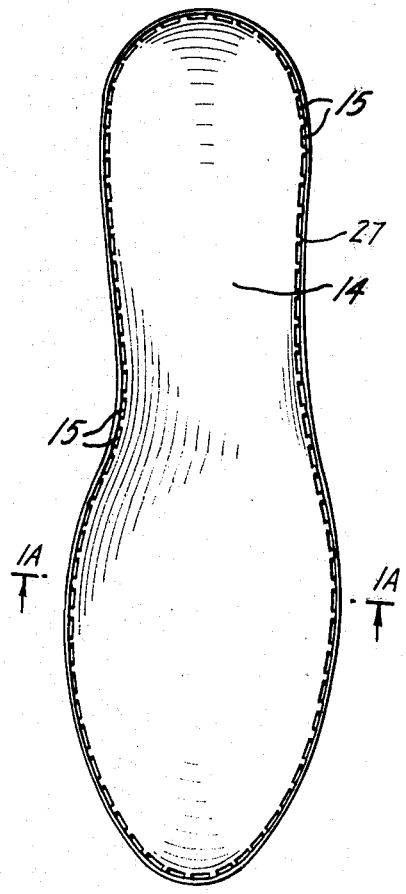
FIG. 2 is a plan view of the lower portion of the shoe as shown in FIG. 1.

As seen in FIG. 2, sufficient slots are provided for the application of a complete shoe upper comprising a tip, vamp and quarter. This same construction can be used for a shoe having less than a complete upper, for example a vamp portion only. The unused slots would be covered with the conventional inner sole, not shown in the drawings. The slots 15 may be of any size, configuration or depth, but it is preferred that they be substantially rectangular in longitudinal dimension and of a depth less than the thickness of the lower portion of the shoe and with a substantially V-shaped section so as to get a perfect fit of the upper 18 before securing with nails or staples 25. The slots are preferably molded into the shoe at the time the lower portion is formed.

Figure 3:
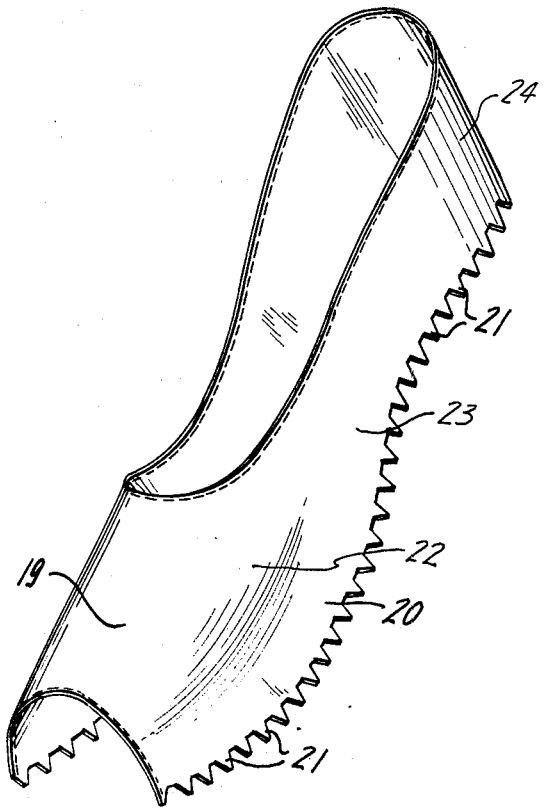
FIG. 3 is a perspective view of a complete open-toe shoe upper for application to the lower portion of the shoe of FIG. 1.
Figure 5:
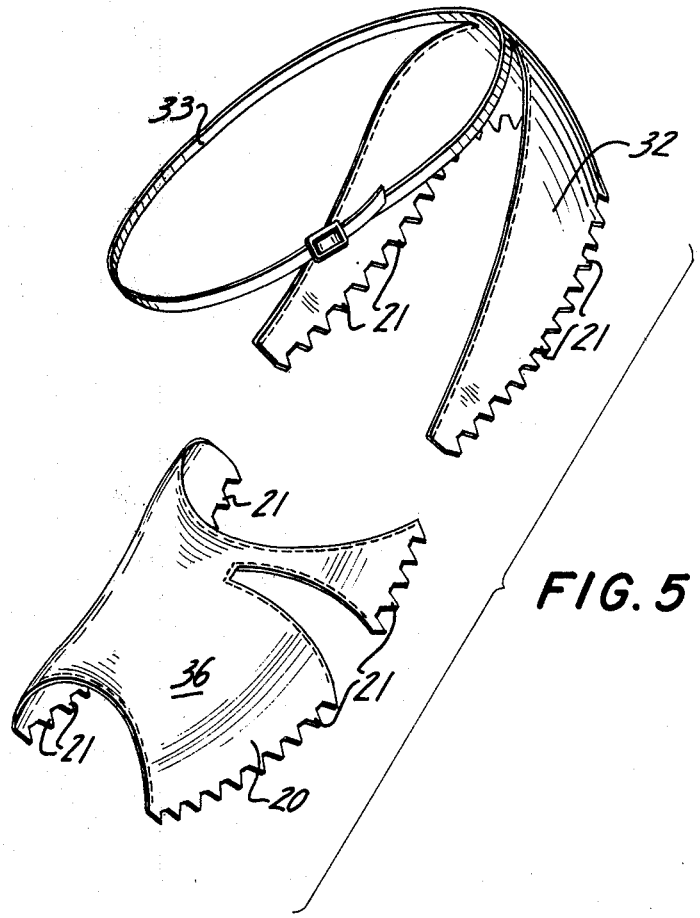
FIG. 5 is a perspective view of an upper comprising a quarter with ankle strip and a vamp for application to the lower portion of the shoe of FIG. 1.
Figure 4:
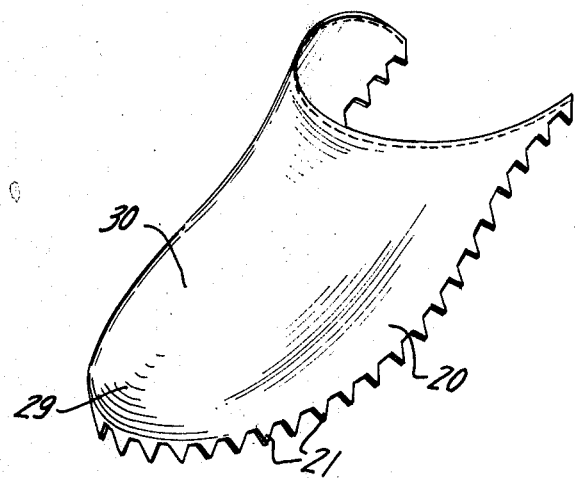
FIG. 4 is a perspective view of a closed-toe shoe upper comprising a tip and vamp for application to the lower portion of the shoe of FIG. 1.

The preformed upper may take any conventional shape, such as a tipless or "open-toe" shoe having a vamp 22 and an arch 23 and a quarter 24 shown in FIG. 3, a tip 29 and vamp 30 generally used with clogs shown in FIG. 4, a two-part upper comprising a quarter 32 and ankle strap 33 and a vamp 36 shown in FIG. 5, or a completely closed toe pump style shoe, not shown.

The preformed upper may take any conventional shape, such as a tipless or "open-toe" shoe having a vamp 22 and an arch 23 and a quarter 24 shown in FIG. 3, a tip 29 and vamp 30 generally used with clogs shown in FIG. 4, a two-part upper comprising a quarter 32 and ankle strap 33 and a vamp 36 shown in FIG. 5, or a completely closed-toe pump style shoe, not shown.

From the foregoing, it is understood that the lower portion of the shoe may be shaped in any manner to provide a given shoe style, and would be provided with slots along the entire periphery of its top surface. With a given lower portion style, a variety of uppers may be used by merely inserting the extended sections of the uppers in the properly selected slots of the lower portion. The upper is then secured to the lower portion by nails or staples inserted through the side of the lower portion and through the V-shaped sections of the upper. There is thus provided a shoe with the appearance of a stitched construction. The uniformity of size is assured because there is no leeway when the upper is affixed to the lower portion, since the V-shaped sections are inserted completely into the slots of the lower portion. The assembly is thus uniform, fast and economical. The application of the conventional inner sole (not shown), lift 16 and sole 17 combine to produce a finished shoe.

What I claim is:

1. A shoe comprising a molded lower portion having a platform, shank and heel, a plurality of slots in the top surface of said platform extending downwardly and adjacent the periphery thereof, an upper having depending sides, a plurality of sections extending downwardly from the edges of said depending sides, said sections adapted to be placed within said slots and means for securing said sections in said slots, wherein said slots are substantially V-shaped slots extending downwardly from said platform and having elongated openings extending along said periphery and said sections are substantially V-shaped.

2. A shoe comprising a molded lower portion having a platform, shank and heel, a plurality of slots in the top surface of said platform extending downwardly and adjacent the periphery thereof, an upper having depending sides, a plurality of sections extending downwardly from the edges of said depending sides, said sections adapted to be placed within said slots and means for securing said sections in said slots, wherein said lower portion has a lateral edge around the periphery thereof, said lateral edge extending above said top surface.

3. A shoe according to claim 1 or 2, wherein said lower portion has a lateral edge around the periphery thereof and wherein said means comprises staples or nails laterally inserted into said edge through said slots and said sections.

4. A shoe according to claim 1 or 2, wherein said upper comprises a tip and a quarter.

5. A shoe according to claim 1 or 2, wherein said upper comprises a vamp.

6. A shoe according to claim 1 or 2, wherein said lower portion is molded of plastic.

* * * * *